United States Patent [19]

Osugi

[11] 4,202,398

[45] May 13, 1980

[54] MOLTEN METAL SURFACE LEVEL DETECTION SYSTEM

[75] Inventor: Kozo Osugi, Tokyo, Japan

[73] Assignee: Furukawa Metals Co. Ltd., Tokyo, Japan

[21] Appl. No.: 959,643

[22] Filed: Nov. 13, 1978

[51] Int. Cl.[2] ..... B22D 11/16

[52] U.S. Cl. ..... 164/150; 164/449; 358/100; 73/293

[58] Field of Search ..... 164/4, 150, 154, 449, 164/155; 358/100; 73/293

[56] References Cited

U.S. PATENT DOCUMENTS

| | | | |
|---|---|---|---|
| 3,838,727 | 10/1974 | Levi et al. | 164/4 |
| 3,842,894 | 10/1974 | Southworth et al. | 164/4 |
| 4,114,675 | 9/1978 | Buhrer | 164/4 |
| 4,132,259 | 1/1979 | Poncet | 164/4 |

*Primary Examiner*—Robert D. Baldwin
*Assistant Examiner*—K. Y. Lin
*Attorney, Agent, or Firm*—George B. Oujevolk

[57] ABSTRACT

In a molten metal surface level detection system, the use of conventional detector means is eliminated and, instead, an ITV camera is provided at an appropriate place where it is neither thermally affected by the molten metal surface portion nor obstructs the site jobs and the molten metal surface portion is photographed by said ITV camera along a direction permitting the surveillance of the level of the molten metal surface and, then, the thus photographed image of the molten metal surface portion is processed in a suitable manner for accurately and reliably detecting the surface level thereof.

1 Claim, 9 Drawing Figures

MOLTEN METAL SURFACE LEVEL DETECTION SYSTEM

BACKGROUND OF THE INVENTION

The present invention relates to a continuous casting machine that is used to continuously produce copper ingots having a diameter of, for example, 200 mm or a belt-wheel type continuous casting machine that continuously produces ingots having a smaller sectional size that are used for producing copper or aluminium rods, to a molten metal surface level detection system which is best-suited for maintaining the surface level of molten metal poured in such a casting machine at a constant level with a high accuracy.

As shown in FIG. 1, in the aforesaid continuous casting machines in general, molten metal 1 is first fed in a reservoir 2 and, then, the molten metal 1 is poured from the resevoir 2 through a gate 3 thereof into a molding device 4 in which cooling water 5 is passed through an internal cavity formed therein, and it is very important to maintain the molten metal surface 6 at a constant level with a high accuracy in view of the quality control of the ingots to be produced therefrom.

Also, in the aforementioned belt-wheel type continuous casting machine (not shown) in which a casting wheel that is rotated in a predetermined direction is provided in a position corresponding to the position of the aforesaid molding device 4 and a belt that goes round in the same direction is provided on the outer side thereof in such a manner that the molten metal is poured from said gate 3 into the space defined by said wheel and belt, the surface of the molten metal poured in said space must be maintained also at a constant level.

For this purpose, it is necessary to detect the level of said molten metal surface 6 for controlling the same and, heretofore, the surface level has been controlled in such a manner that a worker or an operator visually detects the molten metal surface 6 and, then, manually operates a pour controlling pin 7, on the basis of such a visual detection, to increase or decrease the quantity of molten metal flowing into the gate 3 from the reservoir 2.

Therefore, in such a system, not only a quality improvement of ingots has been far from expected because some variation is encountered with each different operator in the controlling operation, but also operators in performing the controlling operation have been subjected to severe working conditions in extremely inferior environment near the casting machine heated to a high temperature. Thus, development of an unattended automatic molten metal surface level detection system has long been desired.

However, as mentioned herein, since the gate 3 directly extends towards the molding device 4 below the same and the molten metal pours out therefrom at a high speed, only a small space could be reserved therein for the provision of surface level sensors that are used to detect the molten metal surface level. Further, since the molten metal is a fluid having a temperature above 1,000° C. and a burner is provided for heating the gate 3, the thermal conditions are much unfavorable to the installation of measuring instruments and, thus, it has not been possible to apply such level sensors conventionally adopted to the molten metal surface level detection system in continuous casting machines.

Therefore, as shown in FIG. 2, it has been proposed to provide a radiation source 9 in the vicinity of the molten metal surface portion 8 including the surface 6 thereof to irradiate radioactive rays onto said molten metal surface portion 8 so that the dosage of radiation 10' permeating the same is counted by means of a dosimeter 11 at a predetermined time interval and the variation of the molten metal surface 6 is detected on the basis of the thus counted dosage.

However, to improve the accuracy in the detection of the molten metal surface level, it is necessary to increase the dosage of radiation permeating said molten metal surface portion per unit of time and, for this purpose, a more powerful radiation source must be provided or the counting time of the dosimeter must be extended.

However, trying to use such a more powerful radiation source requires a use of a larger-sized source and, thus, consumes an unreasonably large space for the installation thereof. While, if the counting time is extended, the detection system becomes unable to keep track of rapid changes in the molten metal surface 6 and, thus, an improved quality control cannot be expected.

In addition, the gate 3 or mold 4 is frequently replaced in the casting machines of the aforementioned type, and since the radiation device is disposed at the site where the aforesaid replacement works are performed, a severe limitation must be imposed on the installation of such a radiation device from a viewpoint of safety and, due to such a safety requirement, the aforecited detection system using radiation has not been satisfactory, in view of its funciton as a surface level sensor.

SUMMARY OF THE INVENTION

To overcome the aforementioned shortcomings of the prior art molten metal surface level detection system, the inventors have conducted a series of intensive studies and achieved the present invention.

Accordingly, the present invention has its object to provide a novel molten metal surface level detection system which can detect the level of the molten metal surface 6 without providing devices such as level sensors in the vicinity of the molten metal surface portion 8 and in which an ITV camera is installed at such an appropriate place where it is neither thermally affected by the molten metal nor obstructs the site jobs, and the molten metal surface portion 8 is photographed by the ITV camera along a direction permitting the surveillance of the level of the molten metal surface 6 and the thus photographed image of the molten metal surface portion 8 is processed in a suitable manner for detecting the surface level thereof.

DETAILED DESCRIPTION OF THE PREFERRED EMBODIMENTS

Hereinafter, the present invention will be described in detail by way of the preferred embodiment thereof with reference to the accompanying drawings, in which.

Figure 1:
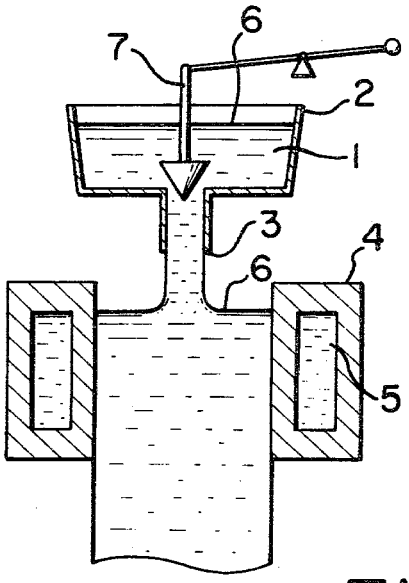
FIG. 1 is a partially broken schematic side section of one example of the prior art manual molten metal surface level detection system as installed onto a continuous casting machine.
Figure 2:
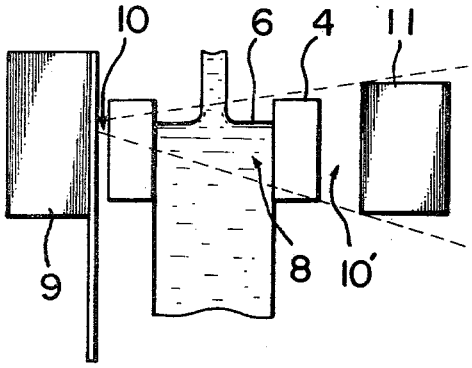
FIG. 2 is a schematic side section of a radiation type molten metal surface level detection system according to the prior art showing essential parts thereof.
Figure 3:
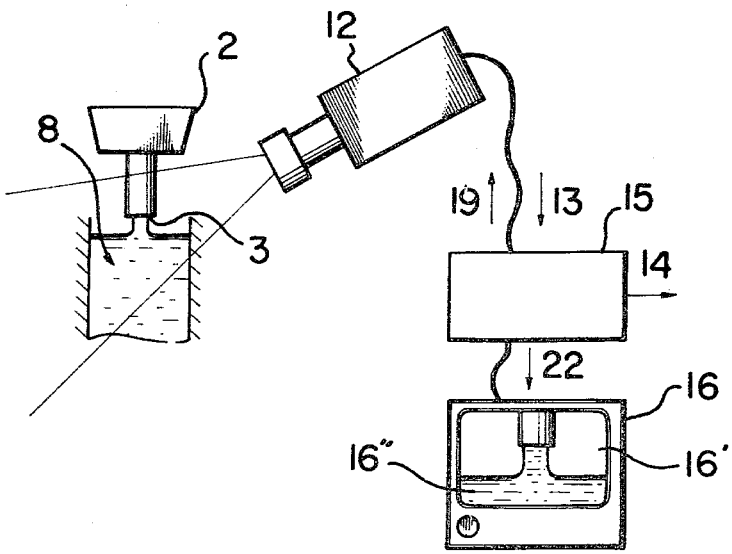
FIG. 3 is a schematic block diagram of a preferred embodiment of the detection device used in the molten metal surface level detection system according to the present invention.
Figure 5A:
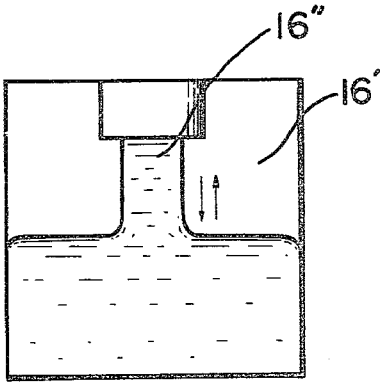
Figure 5B:
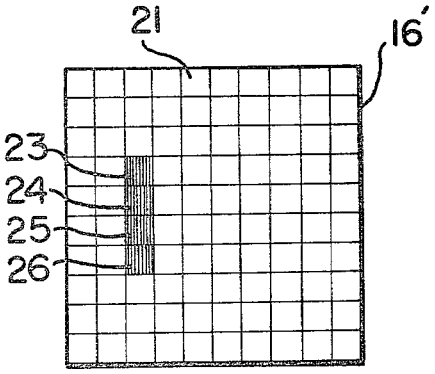
Figure 6A:
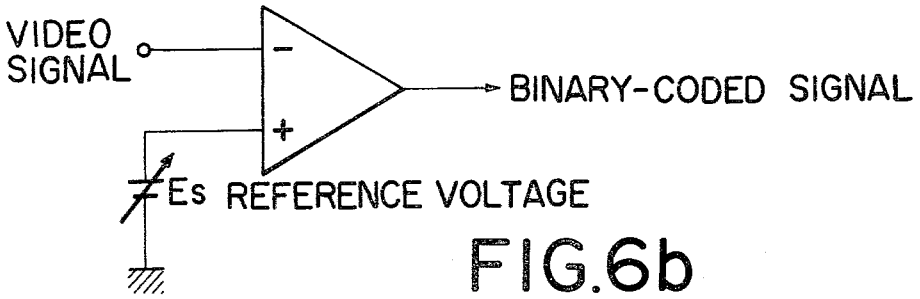
Figure 6B:
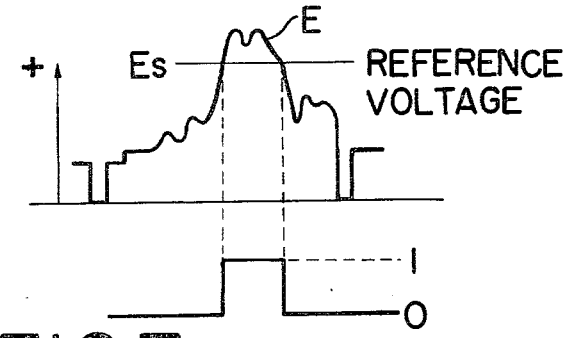
Figure 7:
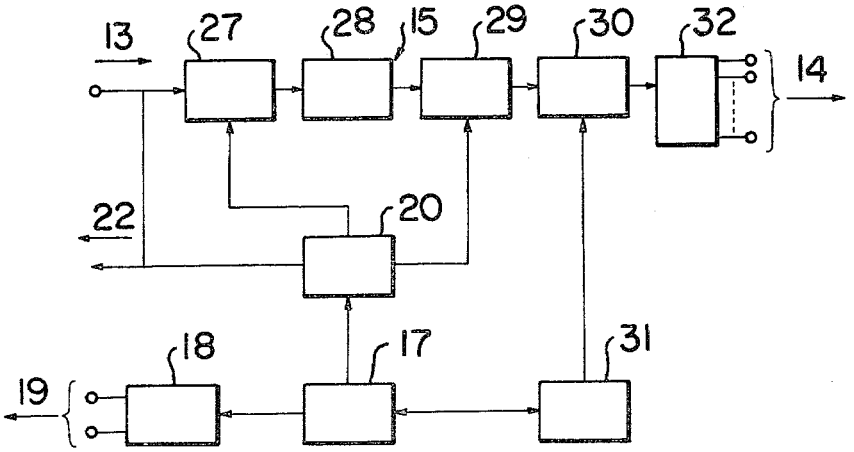

FIG. 5*a* is a front view of said image screen on which the image of the molten metal surface portion is displayed, and FIG. 5*b* is a front view of said image screen on which selected detecting marks are displayed;

FIG. 6*a* is a schematic wiring diagram of a comparator circuit used in said detection device shown in FIG. 3, and FIG. 6*b* is a wave-form diagram illustrating the principle of said comparator circuit shown in FIG. 6*a*; and FIG. 7 is a block diagram of one example of a processing circuit used in said detection device shown in FIG. 3.

Referring now to the drawings, especially, to FIG. 3 showing a preferred embodiment of the detection device used in the molten metal surface level detection system according to the present invention, the reference numeral 12 is an ITV camera for photographing the molten metal surface portion 8 and 15 is a processing circuit to which an input signal 13 is applied from the ITV camera 12 for generating a surface level signal 14 at one output thereof. While, the other output of the processing circuit 15 is coupled to a monitor section 16. As said processing circuit 15, for example, such a circuit as shown in the block diagram of FIG. 7 may be used.

As an experimental example of the molten metal surface level detection system according to the present invention as applied to a casting machine producing copper ingots having a diameter of 200 mm, where molten metal 1 was poured through the gate 3 of 10 mmϕ at about 200 cc/sec. in average, the ITV camera 12 provided with a telephotographic lens having a focal distance of 750 mm was installed at a position 12 m from the molten metal surface 6.

Figure 4:
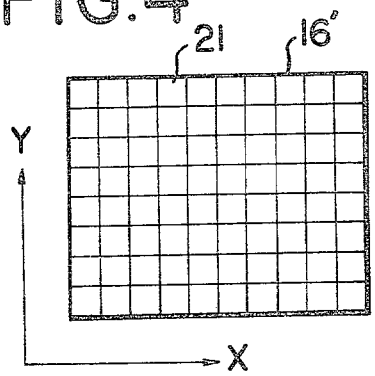
FIG. 4 is a front view of a image screen of a monitor section of said detection device shown in FIG. 3, showing picture elements formed therein.

Referring now to FIG. 7, the reference numeral 17 is a 6 MHz reference frequency oscillator having one output thereof connected to a synchronizing signal generator circuit 18 which in turn generates a vertical and horizontal synchronizing singals 19 that are supplied to the ITV camera 12 to set the scanning speed of the same. While, the other output of the reference frequency oscillator 17 is fed to a picture element divider circuit 20 which generates timing pulses that are used to divide the image screen 16' (monitor screen) into a required number of picture elements 21 each comprising a defined zone obtained by dividing the screen into a ten odd number of sections both along the X and Y-axis thereof (for example, horizontal 16 sections and vertical 12 sections) so as to form a lattice pattern as shown in FIG. 4.

The input signal 13 fed from the ITV camera 12 is synthesized with one output of the picture element dividing circuit 20 and the resultant synthetic signal 22 is applied to the input of the monitor section 16. Thus, on the monitor section 16, an image 16'' derived from the input signal 13 and detecting marks such as 23, 24, 25 and 26 of a desired plurality of picture elements selected out of the aforesaid required number of picture elements as shown in FIG. 5*b* are displayed.

In this case, as shown in FIGS. 5*a* and 5*b*, a plurality of picture elements are selected and it is arranged so that at least one thereof corresponds to a zone of the molten metal surface 6 to be displayed as a detecting mark 23 and remaining picture elements correspond to a zone indicated at 8 in FIG. 3.

As shown in FIG. 7, to an amplifier-clamping circuit 27 to which the signal 13 is applied as an input to the amplifier clamping circuit 27, a comparator circuit 28 is connected, and, in turn, a discriminator circuit 29 is connected to the comparator circuit 28. In this circuit, as said input signal 13 is applied thereto, a gate pulse is generated each time that portion corresponding to the aforementioned selected picture element is scanned, so that a ten odd number of separate scanning lines (line elements) are sampled and, as shown in FIG. 6, the level E of an input signal (image signal) corresponding to said line element is compared with a preset reference voltage Es to obtain a binary-coded signal comprising "0" or "1". These binary-coded signals are temporarily stored in a memory and, upon completing the scanning of said line elements, the number of line element signals that were binary-coded into "1" are counted out of the memory content. When said counts exceed a present number, an output signal indicating that the symbolic value of the binary-coded signal of said picture element is "1" is generated. In this manner, the binary state (black or white) of the entirety of the thus detected mark zone is discriminated.

Since the image screen is divided into picture elements in the aforementioned manner, a filtering effect against minor variation of the images in the picture elements can be obtained and, therefore, the S/N ratio which is often controversial in the detection system of this type can be improved.

The comparator circuit 28 is arranged so that the reference voltage Es can be set at a desired level. While, it is preferable to arrange the picture element divider circuit 20 in such a manner that the picture elements can be selected as desired so that when the wall of the gate 3 is deformed by being melted into the molten metal over a long period of use and, due to this, the position of the image as shown in FIG. 5*a* goes out of place from the position of the detecting mark as shown in FIG. 5*b*, such a discrepancy can be readily corrected.

Further, as shown in FIG. 7, a memory circuit 30 is connected to the output of the discriminator circuit 29, and the other output of the aforementioned reference frequency oscillator 17 is applied to a dynamic controller 31. The dynamic controller 31 generates a sampling pulse which is fed to the memory circuit 30 in such a manner that the output of the discriminator circuit 29 is read into said memory circuit 30 at every sampling time of, for example, 0.5 sec. or 0.1 sec. to be held therein until the next sampling time.

The thus held signal is fed to an output circuit 32 connected to the output of the memory circuit 30, to be converted into a surface level signal 14 constituting an external output signal (open collector or relay signal).

Thus, when the molten metal surface portion 8 is photographed by the ITV camera 12 as shown by the image 16'' of FIG. 5*a*, the image of the molten metal surface portion 8 rapidly tracks the molten metal surface 6 moving in the direction of arrow, because the picture elements are selected as shown in FIG. 5*b*. Therefore, every time the image reaches or leaves the present detecting marks 23, 24, 25 and 26, a symbolic value of binary-coded signal is obtained. Then, the symbolic value derived from each of said plurality of picture elements is used as the input to a control unit such as a computer, where it is logically processed. In this arrangement, for example, even if the detecting mark 23 detects an image when the detecting mark 26 does not detect the same, this does not mean a detection of molten metal, but means an erroneous detection of an image, such as flame image, other than the molten metal. The aforementioned logical processing eliminates the possibility of such an erroneous detection of the molten metal surface level and provides a high reliability of detection.

In the aforementioned detection system, since an ITV camera having a telephotographic lens, the detection accuracy can be increased as desired by changing the focal distance of the lens and, also, the possibility of erroneously detecting burner flame having, for example, an intense bluish light may be eliminated by attaching to the lens a filter that passes only those lights defined in a particular wavelength band.

In the preferred embodiment of the detection system according to the present invention as described hereinbefore, the molten metal surface portion 8 including the molten metal surface 6 is photographed by the ITV camera 12 at some distant position along a direction permitting the surveillance of the molten metal surface 6 poured in the mold 4. From a required plural number of picture element obtained by horizontally and vertically dividing the image screen 16' in the monitor section of the ITV camera, a plurality of picture elements corresponding to said molten metal surface portion are selected in such a manner that at least one thereof corresponds to said molten metal surface 6. Then, input signals from the ITV camera corresponding to the respective picture elements are compared with a preset reference signal so as to encode each line element of each picture element into a binary signal. A corresponding output signal is generated depending upon the state of said binary signal. Then, the output signals associated with said plurality of picture elements are subjected to a logical processing to detect the level of the molten metal surface 6. Thus, since the molten metal surface 6 is monitored through the ITV camera positioned at some distance and the image thereof is processed by way of electric signals, the detection processing can be effected at a higher speed and a rapid change in the molten metal surface 6 can be detected at a higher accuracy as compared with the conventional system using radioactive rays. Further, since detecting marks which can be selected on the image screen of the monitor section as desired are provided, the surface detecting accuracy may be improved by enlarging the image. Also, the provision of a plurality of said detecting marks in combination with the logical processing of the image signals eliminates the possibility of erroneously detecting as the molten metal surface an object that is not the molten metal surface in actuality, such as splashed molten metal.

Further, according to the present invention, since a high degree of freedom is allowed in that the detection device can be set at some distance from the molten metal surface portion, not only is there no possibility of the installed instruments being adversely affected by heat, but also no inconvenience is given thereby to the works on site and, thus, a system having a high reliability can be obtained. Also, since the picture elements are selected as desired, the detecting position range may be set at any place on the image screen. Thus, even if the molten metal surface is inclined, only the detecting marks may be required to be set obliquely and, therefore, no limitation is imposed on the positional relationship between the ITV camera and the object to be photographed thereby. Further, to determine whether the molten metal surface has reached a certain level in the conventional system, it is necessary to convert the sectional area into a corresponding level. While, according to the present invention, the existence of the molten metal surface at a certain level can be easily determined through a simple circuit arrangement. Also, when the surface of the molten metal poured in a mold cannot be discretely discerned from the molten metal being poured, it is difficult to determine only the sectional area of the molten metal under its surface. However, according to the present invention, the controlling data can be processed only in terms of the level of the molten metal surface. Further, although trying to detect the level in accordance with the entire brightness of the object may pick up errors (noise) by detecting an extended or reduced sectional area of the molten metal being poured, the control system according to the present invention can eliminate such a possibility substantially perfectly.

Further, the reliability of the detection system described hereinbefore can be further improved by arranging the aforementioned means for obtaining an output depending upon the state of the binary signal in such a manner that when the number of the binary signals "1" exceed a predetermined number, an output indicating that the symbolic value of that particular picture element is a binary "1" is generated.

What is claimed is:

1. An apparatus for detecting the level of poured molten metal in the liquid phase to eliminate false signals caused by flames and other signal-noise producing factors, comprising in combintion:

(a) an ITV camera which can be placed at some distance from the liquid level to be detected so as to photograph the level of said liquid metal surface including signal circuit means (13) for supplying an input signal;

(b) a reference frequency oscillator with first and second output sides;

(c) a signal generator (18) coupled to said first side of the reference frequency oscillator (17), said signal generator (18) being connected to the camera (12) for generating horizontal and vertical synchronizing signals (19) supplied to said camera (12);

(d) an image screen (16') connected to a picture element divider circuit (20), said picture element divider circuit (20) being coupled to said second output side, and serving to divide said screen (16') into a plurality of rectangular picture elements each being a defined zone along a first and a second axis normal to each other, said screen (16') having an input end receiving said input signal (13) from said signal circuit means;

(e) an amplifier clamping circuit (27) connected to said input signal end (13), a comparator circuit (28) including reference supply means connected to said clamping circuit (27), a discriminator (29) for supplying gate pulses connected to said comparator circuit (28) so that a gate pulse is supplied each time that an element correction to the aforementioned picture elements is scanned so that a plurality of scanning elements are sampled and the level of each element is compared with a reference provided by said reference supply means to provide an output either less than said reference or equal or more than said reference;

(f) a memory (30) connected to said discriminator (29) to temporarily store the output of the discriminator (29);

(g) a dynamic controller (31) coupled to said memory (30) said dynamic controller (31) generating and providing a sampling pulse to the memory (30) so that the output of the discriminator (29) is fed only at predetermined time periods to said memory (30); and, (h) an output level control circuit (32) connected to said memory for controlling the level of the molten liquid when the number of scanned elements having a value equal to or more than said reference exceeds a predetermined number so as to eliminate random signals caused by flame and other noise making materials causing only a random output equal or greater than said reference.

* * * * *